US010124373B2

(12) United States Patent
Daimaru et al.

(10) Patent No.: US 10,124,373 B2
(45) Date of Patent: Nov. 13, 2018

(54) ROTARY CLASSIFIER AND VERTICAL MILL

(71) Applicant: MITSUBISHI HEAVY INDUSTRIES, LTD., Tokyo (JP)

(72) Inventors: Takuichiro Daimaru, Tokyo (JP); Manabu Oda, Tokyo (JP); Kenichi Arima, Tokyo (JP); Shinji Matsumoto, Tokyo (JP); Takashi Tsutsuba, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 977 days.

(21) Appl. No.: 14/414,178

(22) PCT Filed: Aug. 26, 2013

(86) PCT No.: PCT/JP2013/072752
§ 371 (c)(1),
(2) Date: Jan. 12, 2015

(87) PCT Pub. No.: WO2014/034613
PCT Pub. Date: Mar. 6, 2014

(65) Prior Publication Data

US 2015/0196934 A1 Jul. 16, 2015

(30) Foreign Application Priority Data

Aug. 28, 2012 (JP) ..... 2012-187984

(51) Int. Cl.
*B07B 7/083* (2006.01)
*B02C 15/04* (2006.01)
*B02C 15/00* (2006.01)

(52) U.S. Cl.
CPC ..... *B07B 7/083* (2013.01); *B02C 15/04* (2013.01); *B02C 2015/002* (2013.01)

(58) Field of Classification Search
CPC .... B07B 7/083; B02C 15/04; B02C 2015/002
(Continued)

(56) References Cited

U.S. PATENT DOCUMENTS 1,806,980 A * 5/1931 Kreutzberg ..... B02C 15/04 209/722
4,084,754 A * 4/1978 Brundiek ..... B02C 15/001 241/119

(Continued)

FOREIGN PATENT DOCUMENTS

CN 88 1 01496 10/1988
CN 1953823 4/2007

(Continued)

OTHER PUBLICATIONS

International Search Report dated Nov. 12, 2013 in International (PCT) Application No. PCT/JP2013/072752.

(Continued)

*Primary Examiner* — Shelley Self
*Assistant Examiner* — Smith O Bapthelus
(74) *Attorney, Agent, or Firm* — Wenderoth, Lind & Ponack, L.L.P.

(57) ABSTRACT

In a rotary classifier and a vertical mill, a rotary separator (33) is configured such that plural rotary blades (43) are fixed to an outer circumference portion at predetermined intervals in a circumferential direction between an upper support frame (41) and a lower support frame (42), which have a disk-like shape, wherein a tilted surface (52), which tilts at an acute angle relative to a tangent line (T) to a rotation locus (G1) on an outer circumference side and includes a concave portion (51) formed between an outer end (43*a*) and an inner end (43*b*), is formed on a front surface of each of the rotary blades (43) in a rotating direction.

4 Claims, 7 Drawing Sheets

(58) Field of Classification Search
USPC ..... 241/47, 117–123, 286
See application file for complete search history.

(56) References Cited

U.S. PATENT DOCUMENTS

| | | | | | |
|---|---|---|---|---|---|
| 4,127,237 | A | * | 11/1978 | Mehta | B02C 15/04 241/117 |
| 4,684,069 | A | * | 8/1987 | Hashimoto | B02C 15/04 241/119 |
| 5,251,831 | A | * | 10/1993 | Yoshida | B02C 23/32 209/139.1 |
| 5,657,877 | A | * | 8/1997 | Yoshida | B07B 7/083 209/303 |
| 2006/0063091 | A1 | * | 3/2006 | Makino | B07B 7/083 430/110.4 |

FOREIGN PATENT DOCUMENTS

| | | | |
|---|---|---|---|
| DE | 102 61 448 | | 7/2004 |
| JP | 62-241559 | | 10/1987 |
| JP | S62241559 | * | 10/1987 |
| JP | 2-115052 | | 4/1990 |
| JP | 7-51630 | | 2/1995 |
| JP | H0751630 | * | 2/1995 |
| JP | 07-308637 | | 11/1995 |
| JP | 08-266923 | | 10/1996 |
| JP | 9-271721 | | 10/1997 |
| JP | 2002-018301 | | 1/2002 |

OTHER PUBLICATIONS

Written Opinion of the International Searching Authority dated Nov. 12, 2013 in International (PCT) Application No. PCT/JP2013/072752.

Decision of a Patent Grant dated Feb. 16, 2016 in corresponding Japanese Patent Application No. 2012-187984 (English translation).

Chinese Office Action dated Jan. 13, 2016 in corresponding Chinese Patent Application No. 201380039646.4 (English translation).

Office Action dated Sep. 27, 2016 in corresponding Chinese Application No. 201380039646.4, with English Translation.

Notice of Allowance dated Aug. 1, 2016 in corresponding Korean Application No. 10-2015-7002454, with partial English translation.

English translation of Written Opinion of the International Searching Authority dated Nov. 12, 2013 in International (PCT) Application No. PCT/JP2013/072752.

* cited by examiner

ROTARY CLASSIFIER AND VERTICAL MILL

FIELD

The present invention relates to a rotary classifier that mills solid materials such as coal or biomass to fine powders and classifies the fine powders, and a vertical mill including the rotary classifier.

BACKGROUND

Solid fuel such as coal or biomass is used as fuel in combustion equipment for power generation using a boiler. When coal is used as solid fuel, raw coal is milled by a vertical mill to generate powdered coal, and the generated powdered coal is used as fuel.

The vertical mill includes a mill table that can be driven to rotate at a lower part of a housing, plural mill rollers disposed on a top surface of the mill table so as to be rotated with the rotation of the mill table and so as to receive a mill load, and a rotary classifier disposed at an upper part of the housing. With this configuration, when raw coal is supplied on the mill table from a coal feed pipe, the fed raw coal is dispersed on the whole surface due to centrifugal force to form a coal layer, and this coal layer is pressed by each mill roller to be milled. The milled powdered coal is dried by supplied air, and powdered coal with a particle diameter equal to or lower than a predetermined diameter is classified by the rotary classifier. Thus, only powdered coal with an appropriate particle diameter is discharged to the outside.

The patent literatures described below describe a classifier for a vertical mill including a conventional rotary classifier, for example. A rotary classifier for a roller mill described in the patent literature 1 includes a rotary blade formed such that a width of the blade at the upper side is larger than a width of the blade at the lower side. A rotary classifier for a mill described in the patent literature 2 is configured such that a capturing angle of a capturing classifier blade of a rotary impeller is set, and an auxiliary blade extending in the direction reverse to the rotating direction is provided on a tip end at an outer circumference side. A classifying device described in the patent literature 3 is configured such that an upper part of a rotary fin in a rotary classifier is more greatly tilted toward the rotating direction than a lower part of the fin.

CITATION LIST

Patent Literature

Patent Literature 1: Japanese Laid-open Patent Publication No. 08-266923

Patent Literature 2: Japanese Laid-open Patent Publication No. 07-308637

Patent Literature 3: Japanese Laid-open Patent Publication No. 2002-018301

SUMMARY

Technical Problem

In a popular rotary classifier, rotary blades provided along a vertical direction are fixed on circumferences of upper and lower rotation frames at regular intervals in a circumferential direction, and each of the rotary blades tilts at a predetermined angle with respect to the rotating direction.

On the other hand, in powdered coal used for a coal combustion boiler, particles with a diameter of 75 μm or less are said to be optimum, and particles with a diameter of 150 μm or more are said to be unsuitable in general. Therefore, a classifier used for a vertical mill is demanded to allow powdered coal with a particle diameter of 75 μm or less to pass and eliminate powdered coal with a particle diameter of 150 μm or more. Rotary blades with a small tilt angle with respect to a rotating direction can eliminate coarse particles, but may also eliminate fine particles. Rotary blades with a large tilt angle with respect to a rotating direction can allow fine particles to pass, but may also allow coarse particles to pass. Therefore, a classifier that can eliminate coarse particles and allow fine particles to pass has been demanded.

The present invention is accomplished to solve the foregoing problems, and aims to provide a rotary classifier and a vertical mill that can enhance classification efficiency.

Solution to Problem

According an aspect of the present invention, a rotary classifier includes: a frame body that is rotatable and includes an opening on an outer circumference portion; and a plurality of rotary blades fixed to the opening of the frame body at predetermined intervals in a circumferential direction. Each of the plurality of rotary blades includes a tilted surface that tilts at an acute angle relative to a tangent line to a rotation locus at an outer circumference side and that includes a concave portion formed between an outer end and inner end, the tilted surface being formed on a front surface of the rotary blade in a rotating direction.

The rotary blade includes the tilted surface, having the concave portion, on its front surface in the rotating direction. With this configuration, when the plural rotary blades rotate with the frame body, coarse particles having high ability to fly in a straight line are eliminated to the outside after colliding against the tilted surface, while fine particles having low ability to fly in a straight line enter inside after colliding against the tilted surface. Accordingly, the plural rotary blades can eliminate coarse particles and allow fine particles to pass, whereby classification efficiency can be enhanced.

Advantageously, in the rotary classifier, the tilted surface includes a first tilted surface located close to the outer end and a second tilted surface located close to the inner end, and a tilt angle of the first tilted surface relative to the tangent line is set to be larger than a tilt angle of the second tilted surface relative to the tangent line.

The first tilted surface and the second tilted surface are formed on the front surface in the rotating direction. With this configuration, when the plural rotary blades rotate with the frame body, coarse particles having high ability to fly in a straight line are eliminated to the outside, even if they collide against the second tilted surface. On the other hand, fine particles having low ability to fly in a straight line enter inside even if they collide against the first tilted surface. Thus, classification efficiency can be enhanced.

Advantageously, in the rotary classifier, the tilted surface includes a bent line along a vertical direction between the first tilted surface and the second tilted surface.

Since the first tilted surface and the second tilted surface are formed with respect to the bent line, classification efficiency can be enhanced with a simple structure.

Advantageously, in the rotary classifier, the bent line is formed at a middle of the rotary blade in its widthwise direction.

With this configuration, the first tilted surface and the second tilted surface are set as an optimum region.

Advantageously, in the rotary classifier, an angle made by the first tilted surface and the second tilted surface is set to be less than 180 degrees.

With this configuration, coarse particles and fine particles can appropriately be classified by the first tilted surface and the second tilted surface.

Advantageously, in the rotary classifier, the tilted surface includes a curved surface that is curved from the outer end to the inner end.

Since the tilted surface is formed as the curved surface, appropriate classification can be realized, regardless of diameters of particles to be classified.

According to another aspect of the present invention, a vertical mill includes: a hollow housing;

a mill table having a rotation axis along a vertical direction and supported to be driven to rotate at a lower part of the housing; a mill roller arranged opposite to the mill table above the mill table and supported to be rotatable; and a rotary classifier that is provided at an upper part of the housing and that classifies milled materials. Each of plural rotary blades mounted on an outer circumference of the rotary classifier includes a tilted surface that tilts at an acute angle relative to a tangent line to a rotation locus at an outer circumference side and that has a concave portion formed between an outer end and an inner end, the tilted surface being formed on a front surface of each of the rotary blades in a rotating direction.

With this configuration, when solid materials enter between the mill roller and the mill table, the mill roller rotates with the rotation force of the mill table transmitted to the mill roller via the solid materials, whereby the solid materials are milled with pressure load. Then, particles of the milled solid materials move up in the housing, and are classified by the rotary classifier. When the plural rotary blades, each having the tilted surface with the concave portion on the front surface in the rotating direction, rotate with the frame body, coarse particles having high ability to fly in a straight line are eliminated to the outside after colliding against the tilted surface, while fine particles having low ability to fly in a straight line enter inside after colliding against the tilted surface. Accordingly, the plural rotary blades can eliminate coarse particles and allow fine particles to pass, whereby classification efficiency can be enhanced.

Advantageous Effects of Invention

In the rotary classifier and the vertical mill according to the present invention, the tilted surface including the concave portion formed between the outer end and the inner end is formed on the front surface of the rotary blade, whereby classification efficiency can be enhanced.

DESCRIPTION OF EMBODIMENTS

A preferable embodiment of a rotary classifier and a vertical mill according to the present invention will be described below in detail with reference to the accompanying drawings. The present invention is not limited to the embodiment, and when plural embodiments are described, the present invention includes the configuration formed by combining these embodiments.

Embodiment

Figure 1:
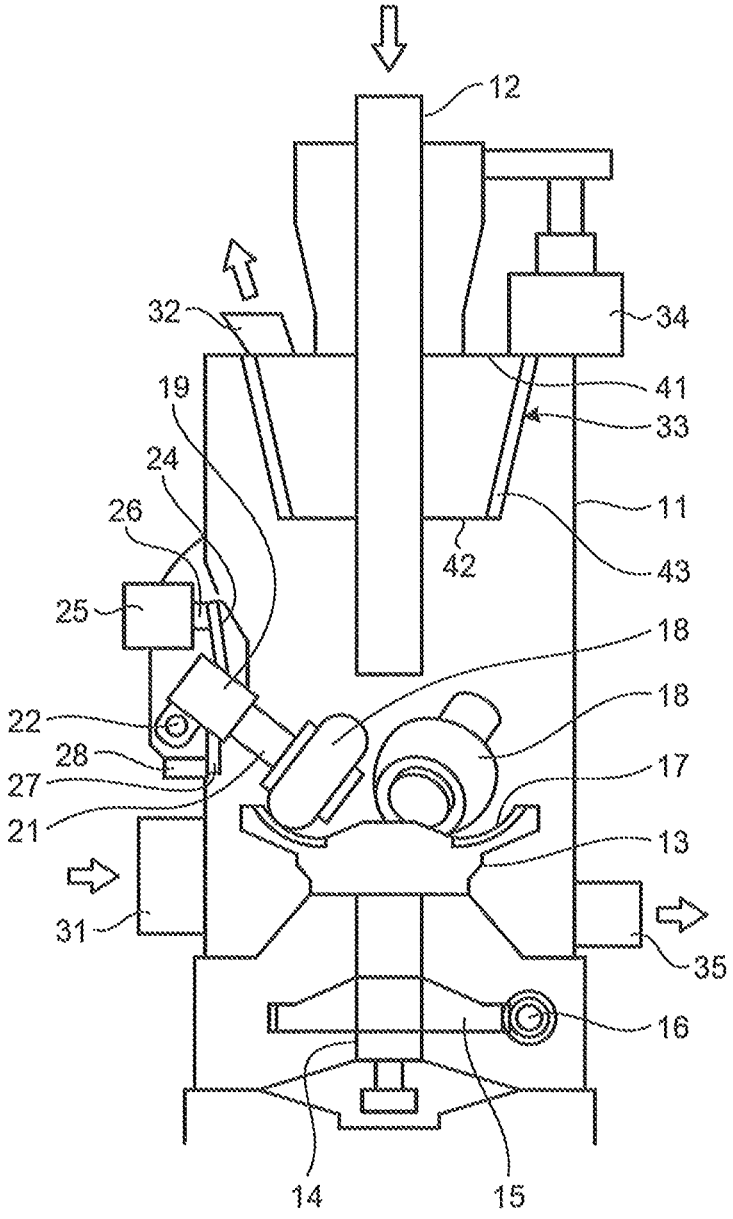
FIG. 1 is a schematic view illustrating a vertical mill according to one embodiment of the present invention.
Figure 2:
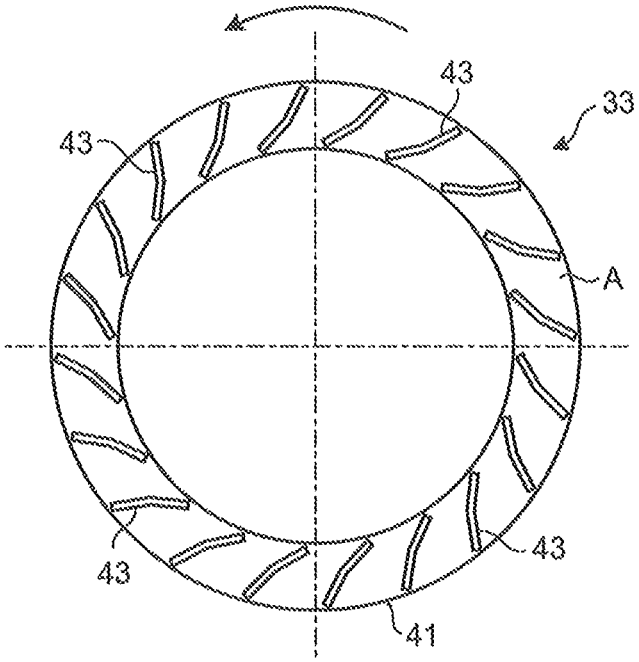
FIG. 2 is a plan view illustrating a rotary classifier according to the embodiment of the present invention.
Figure 3:
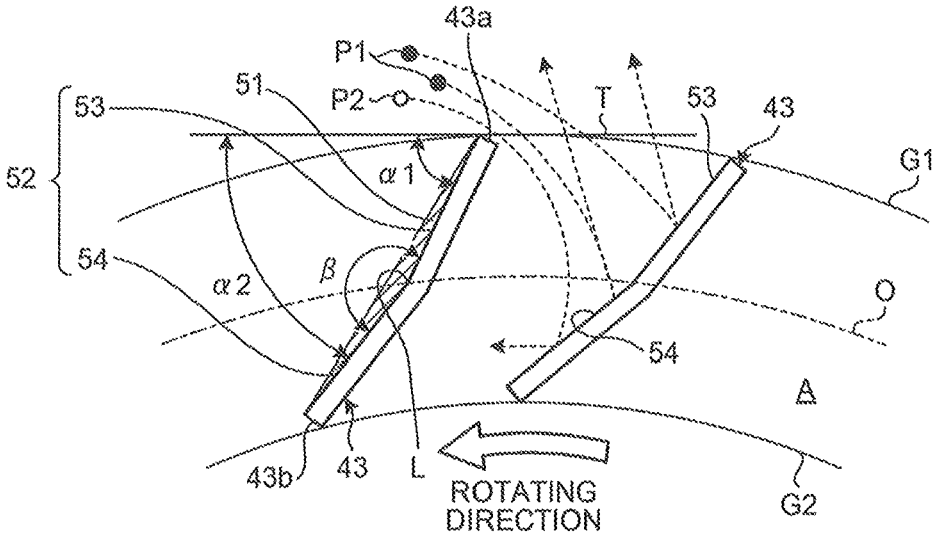
FIG. 3 is a schematic view illustrating a rotary blade in the rotary classifier according to the embodiment of the present invention.
Figure 4:
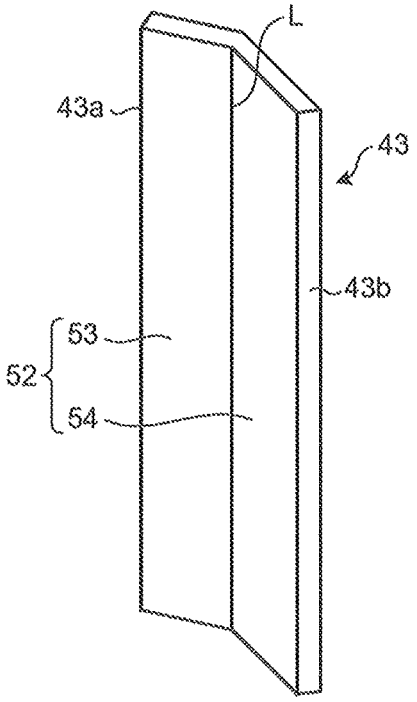
FIG. 4 is a perspective view illustrating the rotary blade.
Figure 5:
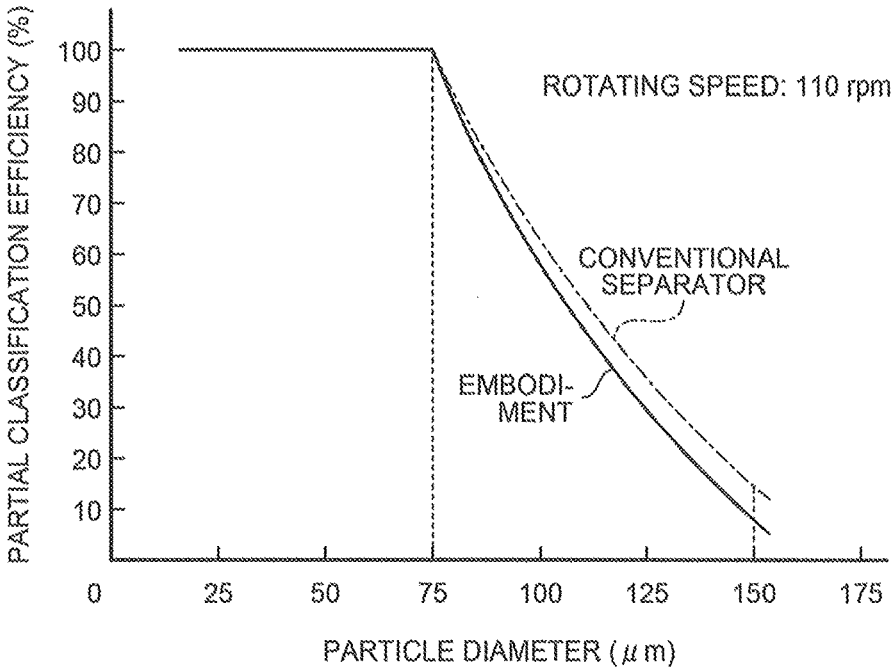
FIG. 5 is a graph illustrating partial classification efficiency to a particle diameter of powdered coal when the rotary blade rotates with 110 rpm.
Figure 6:
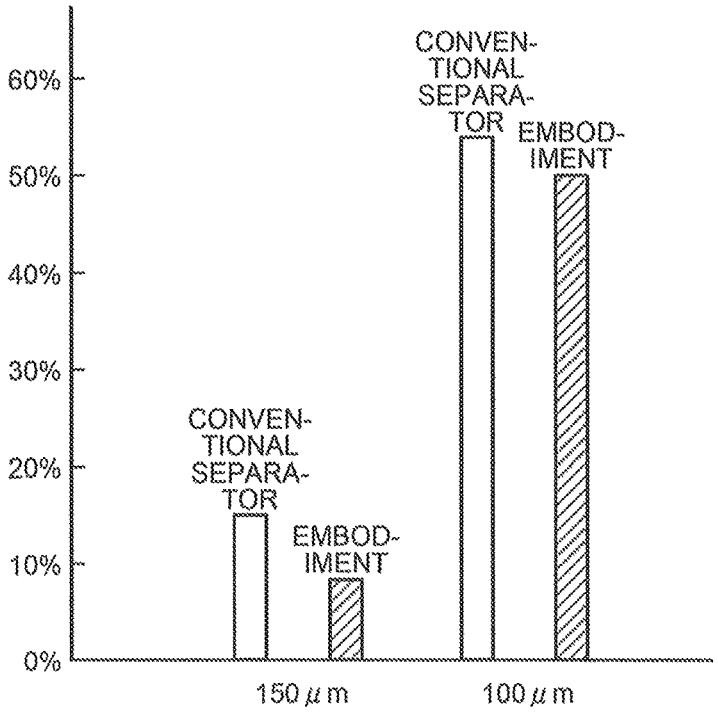
FIG. 6 is a graph for describing an effect of the embodiment of the present invention when the rotary blade rotates with 110 rpm.
Figure 7:
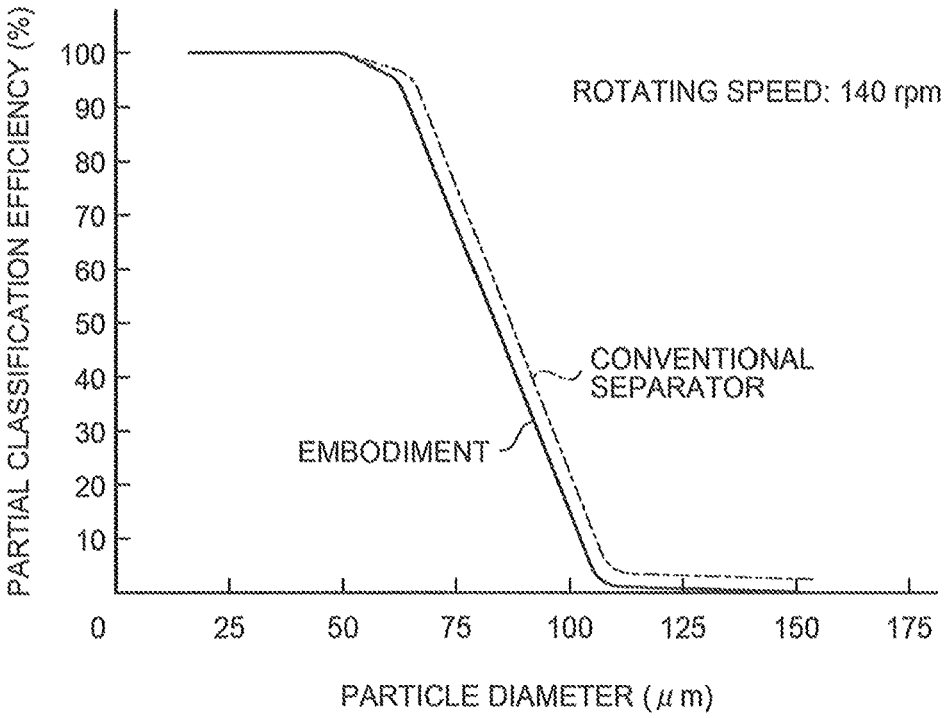
FIG. 7 is a graph illustrating partial classification efficiency to a particle diameter of powdered coal when the rotary blade rotates with 140 rpm.
Figure 8:
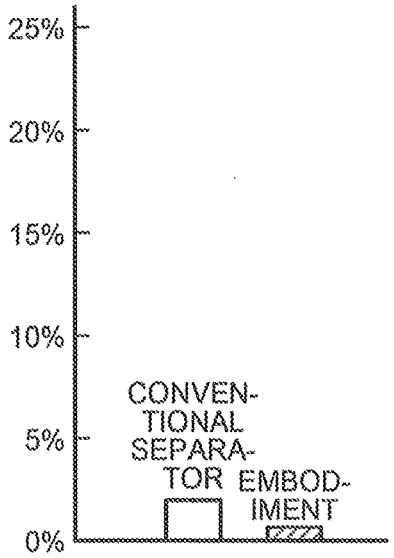
FIG. 8 is a graph for describing an effect of the embodiment of the present invention when the rotary blade rotates with 140 rpm.

FIG. 1 is a schematic view illustrating a vertical mill according to one embodiment of the present invention, FIG. 2 is a plan view illustrating a rotary classifier according to the embodiment of the present invention, FIG. 3 is a schematic view illustrating a rotary blade in the rotary classifier according to the embodiment of the present invention, FIG. 4 is a perspective view illustrating the rotary blade, FIG. 5 is a graph illustrating partial classification efficiency to a particle diameter of powdered coal when the rotary blade rotates with 110 rpm, FIG. 6 is a graph for describing an effect of the embodiment of the present invention when the rotary blade rotates with 110 rpm, FIG. 7 is a graph illustrating partial classification efficiency to a particle diameter of powdered coal when the rotary blade rotates with 140 rpm, and FIG. 8 is a graph for describing an effect of the embodiment of the present invention when the rotary blade rotates with 140 rpm.

The vertical mill according to the present embodiment mills solid materials such as coal (raw coal) or biomass. The biomass means renewable biological organic resources, and examples of the biomass include timbers from forest thinning, scrap woods, driftwoods, grasses, waste materials, sludge, tires, and recycle fuel (pellet or chip) made from these materials. The biomass is not limited to those described above.

As illustrated in FIG. 1, the vertical mill according to the present invention includes a cylindrical hollow housing 11, and a coal feed pipe 12 mounted on the upper part of the housing 11. The coal feed pipe 12 feeds coal into the housing 11 from a coal feed device not illustrated. The coal feed pipe 12 is disposed along the up-down direction direction (vertical direction) at the center of the housing 11, and its lower end extends downward.

A mill table 13 is disposed at the lower part of the housing 11. The mill table 13 is disposed to be opposite to the lower end of the coal feed pipe 12 at the center of the housing 11. A rotation shaft 14 with a rotation axis along the vertical direction is coupled to the bottom of the mill table 13, whereby the mill table 13 is supported to the housing 11 so as to be rotatable. A worm wheel 15 serving as a drive gear is fixedly coupled to the rotation shaft 14, and a worm gear 16 of a drive motor (not illustrated) mounted to the housing 11 is meshed with this worm wheel 15. Accordingly, the mill table 13 can be driven to rotate by the drive motor via the worm gear 16, the worm wheel 15, and the rotation shaft 14.

A table liner 17 with an annular shape is fixed to the outer circumference of the mill table 13. The table liner 17 has an inclined surface (top surface) that becomes higher toward the outer circumference of the mill table 13. Plural mill rollers 18 are arranged above the mill table 13 so as to be opposite to the mill table 13 (table liner 17), and a roller drive device 19 that rotates each mill roller 18 is provided. The roller drive device 19 is a motor, for example, that can apply driving force to the mill rollers 18.

Specifically, the roller drive device 19 that is supported by a sidewall of the housing 11 with a mounting shaft 22 supports a rear end of a support shaft 21, whereby the leading end of the support shaft 21 can swing in the vertical direction. The leading end of the support shaft 21 directs to the rotation axis of the mill table 13, and is mounted to tilt downward. The mill roller 18 is mounted to the leading end of the support shaft 21.

An upper arm 24 extending upward is provided to the roller drive device 19 (support shaft 21), and a leading end of a pressure rod 26 of a hydraulic cylinder 25, which is fixed to the housing 11 to serve as a pressure device, is connected to the leading end of the upper arm 24. A lower arm 27 extending downward is also provided to the roller drive device 19 (support shaft 21), and the leading end thereof can be in contact with a stopper 28 fixed to the housing 11. With this configuration, when the pressure rod 26 moves forward by the hydraulic cylinder 25, the pressure rod 26 presses the upper arm 24 to allow the roller drive device 19 and the support shaft 21 to swing in a clockwise direction in FIG. 1 about the mounting shaft 22. In this case, the swing position of the roller drive device 19 and the support shaft 21 is restricted due to the contact of the lower arm 27 to the stopper 28.

Specifically, the mill roller 18 mills coal with the mill table 13 (table liner 17). For this, a predetermined gap has to be formed between the surface of the mill roller 18 and the mill table 13 (table liner 17). Since the swing position of the support shaft 21 is restricted to a predetermined position by the hydraulic cylinder 25, a predetermined gap in which coal can be introduced and milled is formed between the surface of the mill roller 18 and the surface of the mill table 13.

In this case, when the mill table 13 rotates, coal fed on this mill table 13 is moved to the outer circumference due to centrifugal force, and enters between the mill roller 18 and the mill table 13. The mill roller 18 is pressed against the mill table 13, so that rotation force of the mill table 13 is transmitted via the coal, and the mill roller 18 can rotate with the rotation of the mill table 13.

In the present embodiment, the mill roller 18 is formed to have a conic shape in which the diameter decreases toward the leading end, and to have a flat surface. However, the mill roller 18 is not limited thereto. For example, the mill roller 18 is formed to have a shape of a tire. In the present embodiment, plural (three) mill rollers 18 are disposed at regular intervals along the rotating direction of the mill table 13. In this case, the number and arrangement of the mill rollers 18 may appropriately be set depending on the sizes of the mill table 13 and the mill rollers 18, for example.

An intake port 31, which is located around the mill table 13 and from which primary air is supplied, is formed at the lower part of the housing 11. An outlet port 32, which is located around the coal feed pipe 12 for discharging milled coal (powdered coal), is formed at the upper part of the housing 11. The housing 11 includes a rotary separator 33 that is provided below the outlet port 32 to serve as a rotary classifier classifying powdered coal. The rotary separator 33 is provided on the outer circumference of the coal feed pipe 12, and can be driven to rotate by a drive device 34. A spillage discharge pipe 35 is provided at the lower part of the housing 11. The spillage discharge pipe 35 discharges spillage, such as gravel or metal pieces, contained in coal and falling from the outer circumference of the mill table 13.

The rotary separator 33 serving as the rotary classifier according to the present embodiment will be described here in detail. As illustrated in FIGS. 1 and 2, the rotary separator 33 includes an upper support frame 41 and a lower support frame 42, which have a disk-like shape, and plural rotary blades 43 fixed to an outer circumference portion with predetermined intervals (regular intervals) in the circumferential direction between the upper support frame 41 and the lower support frame 42. Each of the rotary blades 43 is formed into a sheet-like shape, is provided along the up-down direction (vertical direction), and is tilted with respect to the rotating direction of the rotary separator 33. In this case, each rotary blade 43 is formed to tilt in order that the lower end of each rotary blade 43 becomes close to the rotation center of the rotary separator 33, since the outer diameter of the lower support frame 42 is smaller than the outer diameter of the upper support frame 41. The upper support frame 41 and the lower support frame 42 form a frame body of the present invention, and a region between the upper support frame 41 and the lower support frame 42 functions as an opening.

As illustrated in FIGS. 3 and 4, the rotary blade 43 has a tilted surface 52 on its front surface (left surface in FIG. 4) in the rotating direction, the tilted surface 52 tilting at an acute angle relative to a tangent line T to a rotation locus G1 at the outer circumference side, and having a concave portion 51 formed between an outer end 43*a* and an inner end 43*b*. In this case, the tangent line T to the rotation locus G is a tangent line on an intersection of the rotation locus G1 of the rotary blade 43 at the outer circumference side with the outer end 43*a* of the front surface of the rotary blade 43 in the rotating direction.

Specifically, the tilted surface 52 includes a first tilted surface 53 located close to the outer end 43*a* of the rotary blade 43 and a second tilted surface 54 located close to the inner end 43*b*, wherein a tilt angle $\alpha 1$ of the first tilted surface 53 relative to the tangent line T is set larger than a tilt angle $\alpha 2$ of the second tilted surface 54 relative to the tangent line T.

The first tilted surface 53 and the second tilted surface 54 are flat surfaces along the vertical direction, and a bent line L along the up-down direction (vertical direction) is formed between the tilted surfaces 53 and 54. The bent line L is formed at the middle of the rotary blade 43 in the widthwise direction (or the diameter direction of the rotary separator 33). A center locus O crossing the bent line L is located between the rotation locus G1 of the rotary blade 43 at the outer circumference side and the rotation locus G2 at the inner circumference side. Specifically, the width of the first tilted surface 53 and the width of the second tilted surface 54 are set to be almost equal to each other. The angle β made by the first tilted surface 53 and the second tilted surface 54 is set to be less than 180 degrees.

With this configuration, the outer circumference of the rotary separator 33, i.e., the region between the rotation locus G1 of the plural rotary blades 43 at the outer circumference side and the rotation locus G2 at the inner circumference side, is specified as a classification region A. Specifically, when the rotary separator 33 rotates in the direction of an arrow in FIGS. 2 and 3, particles of powdered coal enters the classification region A from the rotation locus G1 of the plural rotary blades 43 at the outer circumference side in this classification region A, and fine particles with a particle diameter smaller than a predetermined particle diameter pass between the rotary blades 43 to enter inside, while coarse particles with a particle diameter larger than the predetermined particle diameter are ejected to the outside by the rotary blades 43.

In the present embodiment, a plate material with a predetermined thickness, predetermined width, and predetermined length (height) is bent at the central position (bent line L) in the widthwise direction, whereby the tilted surface 52 (first tilted surface 53, second tilted surface 54) formed with the concave portion 51 is formed on the front surface of the rotary blade 43 in the rotating direction. The back surface of the rotary blade 43 in the rotating direction has the similar structure. However, the back surface of the rotary blade 43 in the rotating direction may have any shape, so long as it does not affect the rotation resistance or classification performance of the rotary blade 43.

When coal is fed into the housing 11 from the coal feed pipe 12 in the rotary vertical mill thus configured according to the present embodiment as illustrated in FIG. 1, the fed coal falls down in the coal feed pipe 12 to be supplied on the center of the mill table 13. In this case, the mill table 13 rotates with a predetermined speed, whereby the coal supplied on the center of the mill table 13 is dispersed in four directions with centrifugal force to form a constant layer on the whole surface of the mill table 13. In other words, coal enters between the mill roller 18 and the mill table 13.

Then, the rotation force of the mill table 13 is transmitted to the mill roller 18 via the coal, so that the mill roller 18 rotates with the rotation of the mill table 13. In this case, the mill roller 18 is pressed against the mill table 13 by the hydraulic cylinder 25. Therefore, the mill roller 18 presses to mill the coal while rotating.

The coal milled by the mill roller 18, i.e., powdered coal, moves up while being dried by primary air sent into the housing 11 from the intake port 31. The moving-up powdered coal is classified by the rotary separator 33, and coarse particles fall down and are returned onto the mill table 13 to be milled again. On the other hand, fine particles pass through the rotary separator 33, and are discharged from the outlet port 32 on airflow. Spillage such as gravel or metal pieces contained in the coal falls to the outside from the outer circumference due to centrifugal force by the mill table 13, and is discharged from the spillage discharge pipe 35.

Specifically, when the rotary blades 43 rotate at the rotary separator 33 as illustrated in FIG. 3, coarse particles in the powdered coal have large inertia force and high ability to fly in a straight line, since they have a large mass (weight). Therefore, the coarse particle P1 collides against the first tilted surface 53 or the second tilted surface 54 of the rotary blade 43. In either case, the coarse particle P1 hardly passes between the rotary blades 43, resulting in being ejected and discharged to the outside. On the other hand, fine particles in the powdered coal have small inertia force and low ability to fly in a straight line, since they have a smaller mass (weight) than the coarse particles. Accordingly, the fine particle P2 is difficult to collide against the first tilted surface 53 or the second tilted surface 54 of the rotary blade 43. Even if the fine particle P2 collides against either surface, it passes between the rotary blades 43 without being ejected to the outside, and enters inside. Accordingly, the rotary blade 43 can eliminate the coarse particle P1 and catch only the fine particle P2 inside.

A result of a classification simulation of powdered coal by the rotary separator 33 according to the present embodiment will be described here. A graph in FIG. 5 illustrates a classification result of powdered coal for particles with different diameters, wherein the rotating speed of the rotary separator 33 (rotary blade 43) is set to be 110 rpm. A horizontal axis indicates a particle diameter of powdered coal (μm), and a vertical, axis indicates a partial classification efficiency (passage rate %). A solid line indicates the result of the rotary separator 33 (rotary blade 43) according to the present embodiment, and a dashed line indicates the result of a conventional rotary separator (rotary blade with flat surface).

In general, in powdered coal used in a coal combustion boiler, particles with a diameter of 75 μm or less are said to be optimum, and particles with a diameter of 150 μm or more is unsuitable. Therefore, a rotary separator in a vertical mill needs to allow as much powdered coal with a particle diameter of 75 μm or less as possible to pass, and to eliminate as much powdered coal with a particle diameter of 150 μm or more as possible.

As apparent from the graph in FIG. 5, in the classification by the rotary separator 33 (rotary blade 43) indicated by the solid line according to the present embodiment, the rotary separator can allow almost 100% powdered coal with a particle diameter of 75 μm or less to pass, decreases the passage rate of the powdered coal with a particle diameter more than 75 μm, and can eliminate almost 90% or more powdered coal with a particle diameter of 150 μm or more (with the passage rate less than 10%). On the other hand, in the classification by the conventional rotary separator indicated by the dashed line, the conventional rotary separator can allow almost 100% powdered coal with a particle diameter of 75 μm or less to pass and decreases the passage rate of the powdered coal with a particle diameter more than 75 μm. However, the conventional rotary separator can eliminate only about 85% powdered coal with a particle diameter of 150 μm or more (with the passage rate of about 15%).

Specifically, as illustrated in FIG. 6, the rotary separator 33 (rotary blade 43) according to the present embodiment can attain the passage rate of 10% or less for the classification of powdered coal with a particle diameter of 150 μm. On the other hand, the passage rate for the same classification becomes 15% or more in the conventional rotary separator. Specifically, the rotary separator 33 (rotary blade 43) according to the present embodiment more efficiently eliminates powdered coal with a particle diameter of 150 μm or more than the conventional rotary separator, which means that the rotary separator 33 (rotary blade 43) has high classification efficiency.

A graph in FIG. 7 illustrates a classification result of powdered coal for particles with different diameters, wherein the rotating speed of the rotary separator 33 (rotary blade 43) is set to be 140 rpm. The rotating speed of the rotary separator 33 increases to try to prevent the passage of powdered coal with a large particle diameter and reduce an average particle diameter of powdered coal after the classification.

In this case, as apparent from the graph in FIG. 7, in the classification by the rotary separator 33 (rotary blade 43) indicated by the solid line according to the present embodiment, the rotary separator can allow almost 100% powdered coal with a particle diameter of 50 μm or less to pass, decreases the passage rate of the powdered coal with a particle diameter more than 50 μm, and can eliminate almost 95% or more powdered coal with a particle diameter of 100 μm or more (with the passage rate less than 5%). On the other hand, in the classification by the conventional rotary separator indicated by the dashed line, the conventional rotary separator can allow almost 100% powdered coal with a particle diameter of 50 μm or less to pass and decreases the passage rate of the powdered coal with a particle diameter more than 50 μm. However, the conventional rotary separator can eliminate only about 95% powdered coal with a particle diameter of 100 μm or more (with the passage rate of about 5%).

Specifically, as illustrated in FIG. 8, the rotary separator 33 (rotary blade 43) according to the present embodiment can attain the passage rate of about 0% for the classification of powdered coal with a particle diameter of 150 μm. On the other hand, the passage rate for the same classification becomes about 3% in the conventional rotary separator. Specifically, the rotary separator 33 (rotary blade 43) according to the present embodiment more efficiently eliminates powdered coal with a particle diameter of 150 μm or more than the conventional rotary separator, which means that the rotary separator 33 has high classification efficiency.

As described above, in the rotary classifier according to the present embodiment, the rotary separator 33 is configured such that plural rotary blades 43 are fixed to the outer circumference portion at predetermined intervals in a circumferential direction between the upper support frame 41 and the lower support frame 42, which have a disk-like shape, wherein the tilted surface 52, which tilts at an acute angle relative to the tangent line T to the rotation locus G1 at the outer circumference side and includes the concave portion 51 formed between the outer end 43*a* and the inner end 43*b*, is formed on the front surface of each of the rotary blades 43 in the rotating direction.

Each of the rotary blades 43 includes the tilted surface 52, having the concave portion 51, on the front surface in the rotating direction. With this configuration, when the rotary blades 43 rotate, coarse particles having high ability to fly in a straight line are eliminated to the outside after colliding against the tilted surface 52, while fine particles having low ability to fly in a straight line enter inside after colliding against the tilted surface 52. Accordingly, the plural rotary blades 43 can eliminate coarse particles and allow fine particles to pass, whereby classification efficiency can be enhanced.

In the rotary classifier according to the present embodiment, the first tilted surface 53 located close to the outer end 43*a* of the rotary blade 43 and the second tilted surface 54 located close to the inner end 43*b* are formed as the tilted surface 52, wherein the tilt angle $\alpha 1$ of the first tilted surface 53 relative to the tangent line T is set larger than the tilt angle $\alpha 2$ of the second tilted surface 54 relative to the tangent line T. With this configuration, when the rotary blades 43 rotate, coarse particles having high ability to fly in a straight line are eliminated to the outside, even if they collide against the second tilted surface 54 located inside. On the other hand, fine particles having low ability to fly in a straight line enter inside even if they collide against the first tilted surface 53 located outside. Thus, classification efficiency can be enhanced.

In the rotary classifier according to the present embodiment, each of the first tilted surface 53 and the second tilted surface 54 is a flat surface along the vertical direction, and the bent line L along the vertical direction is formed between the tilted surfaces 53 and 54. The formation of the first tilted surface 53 and the second tilted surface 54 relative to the bent line L can enhance classification efficiency with a simple structure.

In the rotary classifier according to the present embodiment, the bent line L is formed at the middle of the rotary blade 43 in the widthwise direction. With this configuration, the first tilted surface 53 and the second tilted surface 54 can be set as an optimum region.

In the rotary classifier according to the present embodiment, the angle made by the first tilted surface 53 and the second tilted surface 54 is set to be less than 180 degrees. With this configuration, coarse particles and fine particles can appropriately be classified by the first tilted surface 53 and the second tilted surface 54.

A vertical mill according to the present embodiment includes a hollow housing 11, a mill table 13 having a rotation axis along a vertical direction and supported to be driven to rotate at a lower part of the housing 11, a mill roller 18 that is arranged opposite to the mill table 13 above the mill table 13 and that is supported to be rotatable, and a rotary separator 33 that is provided in the housing 11 at its upper part as a rotary classifier that can classify powdered coal, wherein each of plural rotary blades 43 mounted on an outer circumference of the rotary separator 33 includes a tilted surface 52 that tilts at an acute angle relative to the tangent line T to the rotation locus G1 at the outer circumference side and that has the concave portion 51 formed between the outer end 43*a* and the inner end 43*b*, the tilted surface 52 being formed on the front surface of each of the rotary blades 43 in a rotating direction.

With this configuration, when coal enters between the mill roller 18 and the mill table 13, the mill roller 18 rotates with the rotation force of the mill table 13 transmitted to the mill roller 18 via the coal, whereby the coal is milled with pressure load. Then, the milled powdered coal moves up in the housing 11, and is classified by the rotary separator 33. When the rotary blades 43 rotate in this case, coarse particles having high ability to fly in a straight line are eliminated to the outside after colliding against the tilted surface 52, while fine particles having low ability to fly in a straight line enter inside after colliding against the tilted surface 52. Accordingly, the plural rotary blades 43 can eliminate coarse particles and allow fine particles to pass, whereby classification efficiency can be enhanced.

In the above embodiment, the first tilted surface 53 and the second tilted surface 54 having different angles are formed on the front surface of the rotary blade 43 in the rotating direction. However, the invention is not limited thereto. Modifications of the rotary blade in the rotary classifier according to the present embodiment will be described below.

Figure 9:
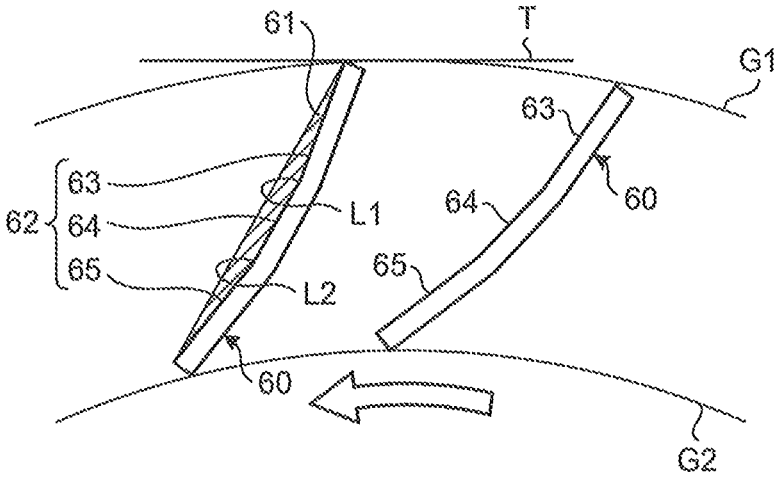
FIG. 9 is a schematic view illustrating a rotary blade in a rotary classifier according to a modification of the present invention.
Figure 10:
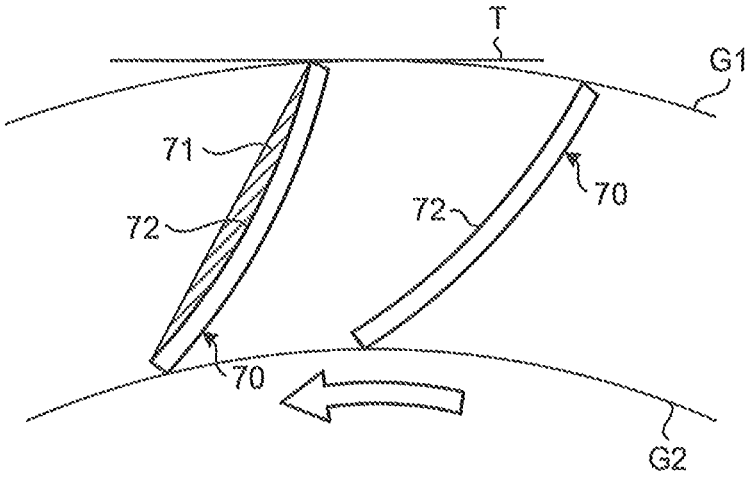
FIG. 10 is a schematic view illustrating a rotary blade in a rotary classifier according to a modification of the present invention.
Figure 11:
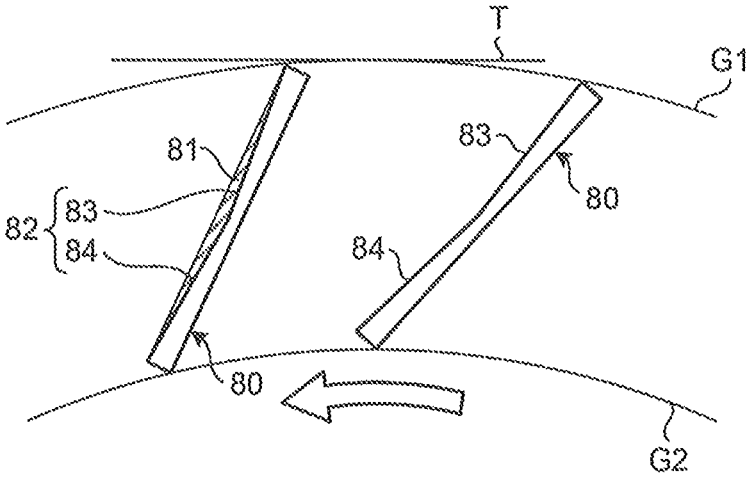
FIG. 11 is a schematic view illustrating a rotary blade in a rotary classifier according to a modification of the present invention.

FIGS. 9 to 11 are schematic views illustrating a rotary blade in a rotary classifier according to modifications of the present invention.

In a first modification, as illustrated in FIG. 9, a rotary blade 60 includes a tilted surface 62 that tilts at an acute angle relative to a tangent line T to a rotation locus G1 at an outer circumference side and has a concave portion 61, the tilted surface 62 being formed on a front surface (left surface in FIG. 9) in a rotating direction. A first tilted surface 63, a second tilted surface 64, and a third tilted surface 65 are formed from the outer side of the rotary blade 60 as the tilted surface 62, wherein the tilt angle of the first tilted surface 63 is the largest, and the tilt angle of the third tilted surface 65 is the smallest.

Each of the tilted surfaces 63, 64, and 65 is a flat surface along the vertical direction, and bent lines L1 and L2 along the up-down direction (vertical direction) are formed between each surface. The width of each of the tilted surfaces 63, 64, and 65 is set to be almost equal by these bent lines L1 and L2. The angle made by the first tilted surface 63 and the third tilted surface 65 is set to be less than 180 degrees.

Like the rotary blade 43, this rotary blade 60 can allow fine particles with a particle diameter smaller than a predetermined particle diameter to pass, and discharge coarse particles with a particle diameter larger than the predetermined particle diameter to the outside, when rotating. The number of the tilted surfaces is not limited to two or three. Four or more tilted surfaces may be formed.

In a second modification, as illustrated in FIG. 10, a rotary blade 70 has a tilted surface 72 that tilts at an acute angle relative to a tangent line T to a rotation locus G1 at an outer circumference side and that has a concave portion 71, the tilted surface 72 being formed on a front surface (left surface in FIG. 10) in a rotating direction. The tilted surface 72 is a curved surface curved from an outer end to an inner end. Like the rotary blade 43, this rotary blade 70 can allow fine particles with a particle diameter smaller than a predetermined particle diameter to pass, and discharge coarse particles with a particle diameter larger than the predetermined particle diameter to the outside, when rotating. The rotary blade 70 has the tilted surface 72 that is the curved surface, whereby it can appropriately classify powdered coal, regardless of particle diameters of powdered coal to be classified.

In a third modification, as illustrated in FIG. 11, a rotary blade 80 has a tilted surface 82 that tilts at an acute angle relative to a tangent line T to a rotation locus G1 at an outer circumference side and that has a concave portion 81, the tilted surface 82 being formed on a front surface (left surface in FIG. 11) in a rotating direction. A first tilted surface 83 and a second tilted surface 84 are formed from the outer side of the rotary blade 80 as the tilted surface 82, wherein the tilt angle of the first tilted surface 83 is set to be larger. Each of the tilted surfaces 83 and 84 has almost the same shape as each of the tilted surfaces 53 and 54 of the rotary blade 43.

The back surface (right surface in FIG. 11) of the rotary blade 80 in the rotating direction is flat so as not to affect rotation resistance or classification performance. Like the rotary blade 43, this rotary blade 80 can allow fine particles with a particle diameter smaller than a predetermined particle diameter to pass, and discharge coarse particles with a particle diameter larger than the predetermined particle diameter to the outside, when rotating.

In the above embodiment, the rotary separator 33 is configured such that the plural rotary blades 43 are fixed on its outer circumference portion between the upper support frame 41 and the lower support frame 42, which have a disk-like shape, at predetermined intervals in a circumferential direction. However, the shapes of the support frames 41 and 42 and the rotary blades 43 are not limited to those in the embodiment.

The rotary classifier according to the present invention is applied to a vertical mill in the above description. However, the present invention is not limited thereto. The rotary classifier may be applied to a device that classifies substances other than powdered coal.

REFERENCE SIGNS LIST

11 HOUSING
12 COAL FEED PIPE
13 MILL TABLE
17 TABLE LINER
18 MILL ROLLER
19 ROLLER DRIVE DEVICE
25 HYDRAULIC CYLINDER
33 ROTARY SEPARATOR (ROTARY CLASSIFIER)
41 UPPER SUPPORT FRAME (FRAME BODY)
42 LOWER SUPPORT FRAME
43, 60, 70, 80 ROTARY BLADE
51, 61, 71, 81 CONCAVE PORTION
52, 62, 72, 82 TILTED SURFACE
53, 63, 83 FIRST TILTED SURFACE
54, 64, 84 SECOND TILTED SURFACE
65 THIRD TILTED SURFACE

The invention claimed is:

1. A rotary classifier comprising:

a frame body that is rotatable and includes an opening on an outer circumference portion; and a plurality of rotary blades fixed to the opening of the frame body at predetermined intervals in a circumferential direction, wherein each of the plurality of rotary blades includes a tilted surface that tilts at an acute angle relative to a tangent line to a rotation locus at an outer circumference side and that includes a concave portion formed between an outer end and inner end, the tilted surface being formed on a front surface of the rotary blade in a rotating direction, the tilted surface includes a first tilted surface which is flat and located close to the outer end, and a second tilted surface which is flat and located close to the inner end, the tilted surface includes a bent line along a vertical direction between the first tilted surface and the second tilted surface, the bent line is located midway between the rotation locus at the outer circumference side and a rotation locus at an inner circumference side of the rotary blade, and a tilt angle of the first tilted surface relative to the tangent line is set to be larger than a tilt angle of the second tilted surface relative to the tangent line.

2. The rotary classifier according to claim 1, wherein an angle made by the first tilted surface and the second tilted surface is set to be less than 180 degrees.

3. The rotary classifier according to claim 1, wherein the tilted surface includes a curved surface that is curved from the outer end to the inner end.

4. A vertical mill comprising:

a hollow housing;

a mill table having a rotation axis along a vertical direction and supported to be driven to rotate at a lower part of the housing;

a mill roller arranged opposite to the mill table above the mill table and supported to be rotatable; and a rotary classifier that is provided at an upper part of the housing and that classifies milled materials, wherein each of a plurality of rotary blades mounted on an outer circumference of the rotary classifier includes a tilted surface that tilts at an acute angle relative to a tangent line to a rotation locus at an outer circumference side and that has a concave portion formed between an outer end and an inner end, the tilted surface being formed on a front surface of each of the rotary blades in a rotating direction, the tilted surface includes a first tilted surface which is flat and located close to the outer end, and a second tilted surface which is flat and located close to the inner end, the tilted surface includes a bent line along a vertical direction between the first tilted surface and the second tilted surface, the bent line is located midway between the rotation locus at the outer circumference side and a rotation locus at an inner circumference side of the rotary blade, and a tilt angle of the first tilted surface relative to the tangent line is set to be larger than a tilt angle of the second tilted surface relative to the tangent line.

* * * * *